US009741353B2

(12) United States Patent
Disch et al.

(10) Patent No.: US 9,741,353 B2
(45) Date of Patent: Aug. 22, 2017

(54) APPARATUS AND METHOD FOR GENERATING A FREQUENCY ENHANCED SIGNAL USING TEMPORAL SMOOTHING OF SUBBANDS

(71) Applicant: Fraunhofer-Gesellschaft zur Foerderung der angewandten Forschung e.V., Munich (DE)

(72) Inventors: Sascha Disch, Fuerth (DE); Ralf Geiger, Erlangen (DE); Christian Helmrich, Erlangen (DE); Markus Multrus, Nuremberg (DE); Konstantin Schmidt, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/812,682

(22) Filed: Jul. 29, 2015

(65) Prior Publication Data

US 2015/0332697 A1 Nov. 19, 2015

Related U.S. Application Data

(63) Continuation of application No. PCT/EP2014/051601, filed on Jan. 28, 2014.
(Continued)

(51) Int. Cl.
*G10L 19/00* (2013.01)
*G10L 19/12* (2013.01)
(Continued)

(52) U.S. Cl.
CPC ..... *G10L 19/12* (2013.01); *G10L 19/0204* (2013.01); *G10L 19/032* (2013.01);
(Continued)

(58) Field of Classification Search
CPC ..... G10L 25/78; G10L 19/012; G10L 19/24; G10L 21/02; G10L 21/0272;
(Continued)

(56) References Cited

U.S. PATENT DOCUMENTS 5,765,127 A 6/1998 Nishiguchi et al.
7,912,712 B2 3/2011 Shlomot et al.
(Continued)

FOREIGN PATENT DOCUMENTS

EP 2019391 A2 1/2009
EP 2214161 A1 8/2010
(Continued)

OTHER PUBLICATIONS

"Digital cellular telecommunications system (Phase 2+); Universal Mobile Telecommunications System (UMTS); Audio codec processing functions; Extended Adaptive Multi-Rate—Wideband (AMR-WB+) codec; Transcoding functions (3GPP TS 26.290 version 7.0.0 Release", ETSI TS 126 290 V7.0.0 Technical Specification; Global System for Mobile Communications (GSM); IEEE LIS; Sophia Anitpolis Cedex, France, vol. 3-SA4, No. V7.0.0, Mar. 2007, 87 pages.
(Continued)

*Primary Examiner* — Vijay B Chawan
(74) *Attorney, Agent, or Firm* — Perkins Coie LLP; Michael A. Glenn

(57) ABSTRACT

An apparatus for generating a frequency enhancement signal has: a signal generator for generating an enhancement signal from a core signal, the enhancement signal having an enhancement frequency range not included in the core signal, wherein a current time portion of the enhancement signal or the core signal has subband signals for a plurality of subbands; a controller for calculating the same smoothing information for the plurality of subband signals of the
(Continued)

enhancement frequency range or the core signal, and wherein the signal generator is configured for smoothing the plurality of subband signals of the enhancement frequency range or the core signal using the same smoothing information.

14 Claims, 14 Drawing Sheets

Related U.S. Application Data

(60) Provisional application No. 61/758,090, filed on Jan. 29, 2013.

(51) Int. Cl.

| | |
|---|---|
| ***G10L 21/0388*** | (2013.01) |
| ***G10L 19/032*** | (2013.01) |
| ***G10L 19/02*** | (2013.01) |
| ***G10L 25/18*** | (2013.01) |
| ***G10L 19/06*** | (2013.01) |
| ***G10L 21/038*** | (2013.01) |

(52) U.S. Cl.
CPC ..... *G10L 19/06* (2013.01); *G10L 21/038* (2013.01); *G10L 21/0388* (2013.01); *G10L 25/18* (2013.01); *G10L 2019/0012* (2013.01); *G10L 2019/0016* (2013.01)

(58) Field of Classification Search
CPC .... G10L 21/038; G10K 11/175; H04R 1/403; H04R 2201/403; H04R 2203/12; H04R 27/00; H04R 3/04; H04R 3/12
USPC ..... 704/205, 208, 210, 230, 500–504, 211, 704/203; 375/240; 381/73.1
See application file for complete search history.

(56) References Cited

U.S. PATENT DOCUMENTS

| | | | | |
|---|---|---|---|---|
| 8,249,861 | B2 | 8/2012 | Li et al. | |
| 8,296,159 | B2 | 10/2012 | Neuendorf et al. | |
| 8,352,279 | B2 | 1/2013 | Gao | |
| 8,560,304 | B2 | 10/2013 | Choo et al. | |
| 8,595,019 | B2 | 11/2013 | Geiger et al. | |
| 8,965,773 | B2 | 2/2015 | Kovesi et al. | |
| 9,026,236 | B2 | 5/2015 | Ishikawa et al. | |
| 9,047,875 | B2 | 6/2015 | Gao | |
| 9,165,567 | B2 * | 10/2015 | Visser | G10L 25/78 704/230 |
| 2002/0002455 | A1 * | 1/2002 | Accardi | G10L 21/0208 704/226 |
| 2002/0198703 | A1 | 12/2002 | Lydecker et al. | |
| 2005/0267744 | A1 | 12/2005 | Nettre et al. | |
| 2006/0140412 | A1 | 6/2006 | Villemoes et al. | |
| 2007/0271102 | A1 * | 11/2007 | Morii | G10L 19/24 704/268 |
| 2008/0027717 | A1 * | 1/2008 | Rajendran | G10L 21/038 704/210 |
| 2008/0120096 | A1 * | 5/2008 | Oh | G10L 19/24 704/211 |
| 2008/0249766 | A1 * | 10/2008 | Ehara | G10L 19/24 704/203 |
| 2009/0112607 | A1 * | 4/2009 | Ashley | G10L 19/24 704/500 |
| 2009/0192802 | A1 * | 7/2009 | Nagaraja | G10L 19/012 704/278 |
| 2009/0201983 | A1 | 8/2009 | Jasiuk et al. | |
| 2010/0176060 | A1 | 7/2010 | Arbogast et al. | |
| 2010/0198588 | A1 | 8/2010 | Sudo et al. | |
| 2010/0217606 | A1 | 8/2010 | Osada et al. | |
| 2010/0262427 | A1 | 10/2010 | Chivukula et al. | |
| 2011/0004479 | A1 | 1/2011 | Ekstrand et al. | |
| 2011/0137659 | A1 | 6/2011 | Honma et al. | |
| 2011/0173004 | A1 | 7/2011 | Bessette et al. | |
| 2011/0238425 | A1 | 9/2011 | Neuendorf et al. | |
| 2011/0264447 | A1 * | 10/2011 | Visser | G10L 25/78 704/208 |
| 2012/0016667 | A1 | 1/2012 | Gao | |
| 2013/0259254 | A1 * | 10/2013 | Xiang | G10K 11/175 381/73.1 |
| 2013/0317812 | A1 | 11/2013 | Jeong et al. | |
| 2015/0255073 | A1 | 9/2015 | Gao | |

FOREIGN PATENT DOCUMENTS

| | | | |
|---|---|---|---|
| EP | 2273493 | A1 | 1/2011 |
| JP | 2013531281 | A | 8/2013 |
| JP | 2014508322 | A | 4/2014 |
| RU | 2449387 | C2 | 4/2012 |
| RU | 2454738 | C2 | 6/2012 |
| RU | 2455710 | C2 | 7/2012 |
| RU | 2471253 | C2 | 12/2012 |
| RU | 2011126331 | A | 1/2013 |
| TW | 201124981 | A | 7/2011 |
| WO | 0241301 | A1 | 5/2002 |
| WO | 2004010415 | A1 | 1/2004 |
| WO | 2010003543 | A1 | 1/2010 |
| WO | 2010039646 | A1 | 4/2010 |
| WO | 2010040522 | A2 | 4/2010 |
| WO | 2010069885 | A1 | 6/2010 |
| WO | 2010114123 | A1 | 10/2010 |
| WO | 2010115850 | A1 | 10/2010 |
| WO | 2011110031 | A1 | 9/2011 |
| WO | 2011148230 | A1 | 12/2011 |
| WO | 2012012414 | A1 | 1/2012 |
| WO | 2012017621 | A1 | 2/2012 |
| WO | 2012108680 | A3 | 11/2012 |
| WO | 2014118159 | A1 | 8/2014 |
| WO | 2014118161 | A1 | 8/2014 |

OTHER PUBLICATIONS

Jax, P., "Bandwidth Extension for Speech", Chapter 6 of "Audio Bandwidth Extension: Application of Psychoacoustics, Signal Processing and Loudspeaker Design", R. M., Wiley, DOI: 10.1002/047085871, Dec. 6, 2005, pp. 172-235.

Kontio, et al., "Neural Network-Based Artificial Bandwidth Expansion of Speech,", IEEE Transactions on Audio, Speech and Language Processing, vol. 15,, Mar. 2007, pp. 873-881.

Kornagel, et al., "Techniques for Artificial Bandwidth Extension of Telephone Speech", Signal Processing, Eslevier Science Publishes B.V. Amsterdam, NL, vol. 86, No. 6, Jun. 1, 2006, pp. 1296-1306, ISSN: 0165-1684, DOI: 10.1016/J.SIGPRO.2005.07.039.

Wikipedia, "Spectral Centroid", Obtained from the Wayback Machine at:: https://web.archive.org/web/20120722003303/http://en.wikipedia.org/wiki/Spectral_centroid, Oct. 12, 2011, 1 page.

* cited by examiner

APPARATUS AND METHOD FOR GENERATING A FREQUENCY ENHANCED SIGNAL USING TEMPORAL SMOOTHING OF SUBBANDS

CROSS-REFERENCE TO RELATED APPLICATIONS

This application is a continuation of copending International Application No. PCT/EP2014/051601, filed Jan. 28, 2014, which is incorporated herein by reference in its entirety, and additionally claims priority from U.S. Provisional Application No. 61/758,090, filed Jan. 29, 2013, which is also incorporated herein by reference in its entirety.

BACKGROUND OF THE INVENTION

The present invention is based on audio coding and in particular on frequency enhancement procedures such as bandwidth extension, spectral band replication or intelligent gap filling.

The present invention is particularly related to non-guided frequency enhancement procedures, i.e. where the decoder-side operates without side information or only with a minimum amount of side information.

Perceptual audio codecs often quantize and code only a lowpass part of the whole perceivable frequency range of an audio signal, especially when operated at (relatively) low bitrates. Although this approach guarantees an acceptable quality for the coded low-frequency signal, most listeners perceive the missing of the highpass part as a quality degradation. To overcome this issue, the missing high-frequency part can by synthesized by bandwidth extension schemes.

State of the art codecs often use either a waveform-preserving coder, such as AAC, or a parametric coder, such as a speech coder, to code the low-frequency signal. These coders operate up to a certain stop frequency. This frequency is called crossover frequency. The frequency portion below the crossover frequency is called low band. The signal above the crossover frequency, which is synthesized by means of a bandwidth extension scheme, is called high band.

A bandwidth extension typically synthesizes the missing bandwidth (high band) by means of the transmitted signal (low band) and extra side information. If applied in the field of low-bitrate audio coding, the extra information should consume as little as possible extra bitrate. Thus, usually a parametric representation is chosen for the extra information. This parametric representation is either transmitted from the encoder at comparably low bitrate (guided bandwidth extension) or estimated at the decoder based on specific signal characteristics (non-guided bandwidth extension). In the latter case, the parameters consume no bitrate at all.

The synthesis of the high band typically consists of two parts:

1. Generation of the high-frequency content. This can be done by either copying or flipping (parts of) the low frequency content to the high band, or inserting white or shaped noise or other artificial signal portions into the high band.
2. Adjustment of the generated high frequency content according to the parametric information. This includes manipulation of shape, tonality/noisiness and energy according to the parametric representation.

The goal of the synthesis process is usually to achieve a signal that is perceptually close to the original signal. If this goal can't be matched, the synthesized portion should be least disturbing for the listener.

Other than a guided BWE scheme, a non-guided bandwidth extension can't rely on extra information for the synthesis of the high band. Instead, it typically uses empirical rules to exploit correlation between low band and high band. Whereas most music pieces and voiced speech segments exhibit a high correlation between high and low frequency band, this is usually not the case for unvoiced or fricative speech segments. Fricative sounds have very few energy in the lower frequency range while having high energy above a certain frequency. If this frequency is close to the crossover frequency, then it can be problematic to generate the artificial signal above the crossover frequency since in that case the lowband does contain little relevant signal parts. To cope with this problem, a good detection of such sounds is helpful.

HE-AAC is a well-known codec that consists of a waveform preserving codec for the low band (AAC) and a parametric codec for the high band (SBR). At decoder side, the high band signal is generated by transforming the decoded AAC signal into the frequency domain using a QMF filterbank. Subsequently, subbands of the low band signal are copied to the high band (generation of high frequency content). This high band signal is then adjusted in spectral envelope, tonality and noise floor based on the transmitted parametric side-information (adjustment of the generated high frequency content). Since this method uses a guided BWE approach, a weak correlation between high and low band is in general not problematic and can be overcome be transmitting the appropriate parameter sets. However, this necessitates additional bitrate, which might not be acceptable for a given application scenario.

The ITU Standard G.722.2 is a speech codec that operates in time domain only, i.e. without performing any calculations in frequency domain. Such a decoder outputs a time domain signal with a sampling rate of 12.8 kHz, which is subsequently upsampled to 16 kHz. The generation of the high frequency content (6.4-7.0 kHz) is based on inserting bandpass noise. In most operation modes the spectral shaping of the noise is done without using any side-information, only in the operation mode with highest bitrate information about the noise energy is transmitted in the bitstream. For reasons of simplicity, and since not all application scenarios can afford the transmission of extra parameters sets, in the following only the generation of the high band signal without using any side-information is described.

For generating the high band signal, a noise signal is scaled to have the same energy as the core excitation signal. In order to give more energy to unvoiced parts of the signal, a spectral tilt e is calculated:

$$e = \frac{\sum_{n=1}^{63} s(n)s(n-1)}{\sum_{n=0}^{63} s^2(n)}$$

where s is the high-pass filtered decoded core signal with cut-off frequency of 400 Hz. n is the sample index. In case of voiced segments where less energy is present at high frequencies, e approaches 1, while for unvoiced segments e is close to zero. In order to have more energy in the high band signal, for unvoiced speech the energy of the noise is multiplied by (1−e). Finally, the scaled noise signal is filtered by a filter which is derived from the core Linear Predictive Coding (LPC) filter by extrapolation in the Line Spectral Frequency (LSF) domain.

The non-guided bandwidth extension from G.722.2, which entirely operates in time domain, has the following drawbacks:

1. The generated HF content is based on noise. This creates audible artifacts if the HF signal is combined with a tonal, harmonic low-frequency signal (e.g. music). To avoid such artifacts, G.722.2 strongly limits the energy of the generated HF signal, which also limits potential benefits of the bandwidth extension. Thus, unfortunately also the maximum possible improvement of the brightness of a sound or the maximum obtainable increase in intelligibility of a speech signal is limited.
2. Since this non-guided bandwidth extension operates in the time domain, the filter operations cause additional algorithmic delay. This additional delay lowers the quality of the user experience in bi-directional communication scenarios or might not be allowed by the terms of requirement of a given communication technology standard.
3. Also, since the signal processing is performed in time domain, the filter operations are prone to instabilities. Moreover, the time domain filters have a high computational complexity.
4. Since only the overall sum of the energy of the high band signal is adapted to the energy of the core signal (and further weighted by the spectral tilt), there might be a significant local mismatch of energy at the crossover frequency between upper frequency range of the core signal (the signal just below the crossover frequency) and the high band signal. For example, this will be the case especially for tonal signals that exhibit an energy concentration in the very low frequency range but contain little energy in the upper frequency range.
5. Furthermore, it is computationally complex to estimate a spectral slope in a time domain representation. In frequency domain, an extrapolation of a spectral slope can be done very efficiently. Since most of the energy of e.g. fricatives is concentrated in the high frequency range, these may sound dull if a conservative energy and spectral slope estimation strategy like in G.722.2 is applied (see 1).

To summarize, the known non-guided or blind bandwidth extension schemes may necessitate a significant computational complexity on the decoder side and nevertheless result in a limited audio quality specifically for problematic speech sounds such as fricatives. Furthermore, guided bandwidth extension schemes, although providing a better audio quality and sometimes necessitating less computational complexity on the decoder side cannot provide the substantial bitrate reductions due to the fact that the additional parametric information on the high band can necessitate a significant amount of additional bitrate with respect to the encoded core audio signal.

It is therefore an object of the present invention to provide an improved concept for audio processing in the context of non-guided frequency enhancement technologies.

SUMMARY

According to an embodiment, an apparatus for generating a frequency enhancement signal may have: a signal generator for generating an enhancement signal from a core signal, the enhancement signal having an enhancement frequency range not included in the core signal, wherein a current time portion of the enhancement signal or the core signal has subband signals for a plurality of subbands; a controller for calculating the same smoothing information for the plurality of subband signals of the enhancement frequency range or the core signal, and wherein the signal generator is configured for smoothing the plurality of subband signals of the enhancement frequency range or the core signal using the same smoothing information, wherein the controller is configured to calculate the smoothing information using a combined energy of the plurality of subband signals of the core signal and the frequency enhancement signal or using only the frequency enhancement signal of the current time portion, and using an average energy of the plurality of subband signals of the core signal and the frequency enhancement signal or of the core signal only of one or more earlier time portions preceding the current time portion or one or more later time portions following the current time portion.

According to another embodiment, a method of generating a frequency enhancement signal may have the steps of: generating an enhancement signal from a core signal, the enhancement signal having an enhancement frequency range not included in the core signal, wherein a current time portion of the enhancement signal or the core signal has subband signals for a plurality of subbands; calculating the same smoothing information for the plurality of subband signals of the enhancement frequency range or the core signal, and wherein the generating has smoothing the plurality of subband signals of the enhancement frequency range or the core signal using the same smoothing information, wherein the calculating has calculating the smoothing information using a combined energy of the plurality of subband signals of the core signal and the frequency enhancement signal or using only the frequency enhancement signal of the current time portion, and using an average energy of the plurality of subband signals of the core signal and the frequency enhancement signal or of the core signal only of one or more earlier time portions preceding the current time portion or one or more later time portions following the current time portion.

According to still another embodiment, a system for processing audio signals may have: an encoder for generating an encoded core signal; and an apparatus for generating a frequency enhancement signal as mentioned above.

According to another embodiment, a method of processing audio signals may have the steps of: generating an encoded core signal; and generating a frequency enhancement signal using a method of generating a frequency enhancement signal as mentioned above.

Another embodiment may have a computer program for performing, when running on a computer or a processor, the methods as mentioned above.

The present invention provides a frequency enhancement scheme such as a bandwidth extension scheme for audio codecs. This scheme aims at extending the frequency bandwidth of an audio codec without the need of extra side-information or with only a minimum amount significantly reduced compared to a full parametric description of missing bands as in guided bandwidth extension schemes.

An apparatus for generating a frequency enhanced signal comprises a calculator for calculating a value describing an energy distribution with respect to frequency in a core signal. A signal generator for generating an enhancement signal comprising an enhancement frequency range not included in the core signal operates using the core signal and then performs a shaping of the enhancement signal or the core signal so that the spectral envelope of the enhancement signal depends on the value describing the energy distribution.

Thus, the envelope of the enhancement signal, or the enhancement signal is shaped based on this value describing the energy distribution. This value can be easily calculated and this value then defines the full envelope shape or the full shape of the enhancement signal. Thus, the decoder can operate with a low complexity and at the same time a good audio quality is obtained. Specifically, the energy distribution in the core signal when used for the spectral shaping of the frequency enhancement signal results in a good audio quality even though the processing of calculating the value on the energy distribution such as a spectral centroid in the core signal and the adjustment of the enhancement signal based on this spectral centroid is a procedure which is straightforward and can be performed with low computational resources.

Furthermore, this procedure allows that the absolute energy and the slope (roll-off) of the high band signal are derived from the absolute energy and the slope (roll-off) of the core signal, respectively. It is of advantage to perform these operations in the frequency domain so that they can be done in the computationally efficient way, since the shaping of a spectral envelope is equivalent to simply multiplying the frequency representation with a gain curve, and this gain curve is derived from the value describing the energy distribution with respect to frequency in the core signal.

Furthermore it is computationally complex to precisely estimate and extrapolate a given spectral shape in the time domain. Thus, such operations may be performed in the frequency domain. Fricative sounds for example have typically only a low amount of energy at low frequencies and a high amount of energy at high frequencies. The rise in energy is dependent on the actual fricative sound and might start only little below the crossover frequency. In the time domain, it is difficult to detect this situation and computationally complex to obtain a valid extrapolation from it. For non-fricative sounds it is assured that the energy of the artificial generated spectrum drops with rising frequency.

In a further aspect, a temporal smoothing procedure is applied. A signal generator for generating an enhancement signal from a core signal is provided. A time portion of the enhancement signal or the core signal comprises subband signals for a plurality of subbands. A controller for calculating the same smoothing information for the plurality of subband signals of the enhancement frequency range is provided and this smoothing information is then used by the signal generator for smoothing the plurality of subband signals of the enhancement frequency range, particularly using the same smoothing information or, alternatively, when the smoothing is performed before the high frequency generation, then the plurality of subband signals of the core signal are smoothed all using the same smoothing information. This temporal smoothing avoids the continuation of smaller fast energy fluctuations, which are inherited from the low-band, to the high-band, and thus leads to a more pleasant perceptual impression. The low-band energy fluctuations are usually caused by quantization errors of the underlying core-coder that lead to instabilities. The smoothing is signal adaptive since it is dependent on the (long-term) stationary of the signal. Furthermore, the usage of one and the same smoothing information for all individual subbands makes sure that the coherency between the subbands is not changed by the temporal smoothing. Instead, all subbands are smoothed in the same way, and the smoothing information is derived from all subbands or from only the subbands in the enhancement frequency range. Thus, a significantly better audio quality compared to an individual smoothing of each subband signal individually is obtained.

A further aspect is related to performing an energy limitation, advantageously at the end of the whole procedure for generating the enhancement signal. A signal generator for generating an enhancement signal from a core signal is provided, where the enhancement signal comprises an enhancement frequency range not included in the core signal, where a time portion of the enhancement signal comprises subband signals for one or a plurality of subbands. A synthesis filterbank for generating the frequency enhancement signal using the enhancement signal is provided, where the signal generator is configured for performing an energy limitation in order to make sure that the frequency enhancement signal obtained by the synthesis filterbank is so that an energy of a higher band is, at the most, equal to an energy in a lower band or greater than, at the most, by a predefined threshold. This may apply for a single extension band. Then, the comparison or energy limitation is done using the energy of the highest core band. This may also apply for a plurality of extension bands. Then a lowest extension band is energy limited using the highest core band, and a highest extension band is energy limited with respect to the second to highest extension band.

This procedure is particularly useful for non-guided bandwidth extension schemes, but can also help in guided bandwidth extension schemes, since the non-guided bandwidth extension schemes are prone to artifacts caused by spectral components which stick out unnaturally, especially at segments which have a negative spectral tilt. These components might lead to high-frequency noise-bursts. To avoid such a situation, the energy limitation may be applied at the end of the processing, which limits the energy increment over frequency. In an implementation, the energy at a QMF (Quadrature Mirror Filtering) subband k must not exceed the energy at a QMF subband k−1. This energy limiting might be performed on a time-slot base or to save on complexity, only once per frame. Thus, it is made sure that any unnatural situations in bandwidth extension schemes are avoided, since it is very unnatural that a higher frequency band has more energy than the lower frequency band or that the energy of a higher frequency band is higher by more than the predefined threshold, such as a threshold of 3 dB, than the energy in the lower band. Typically, all speech/music signals have a low-pass characteristic, i.e. have a more or less monotonically decreasing energy content over frequency. This may apply for a single extension band. Then, the comparison or energy limitation is done using the energy of the highest core band. This may also apply for a plurality of extension bands. Then a lowest extension band is energy limited using the highest core band, and a highest extension band is energy limited with respect to the second to highest extension band.

Although the technologies of shaping of the frequency enhancement signal, temporal smoothing of the frequency enhancement subband signals and energy limitation can be performed individually and separately from each other, these procedures can also be performed all together within advantageously a non-guided frequency enhancement scheme.

BRIEF DESCRIPTION OF THE DRAWINGS

Embodiments of the present invention are subsequently described with respect to the accompanying drawings, in which.

DETAILED DESCRIPTION OF THE INVENTION

Figure 1:
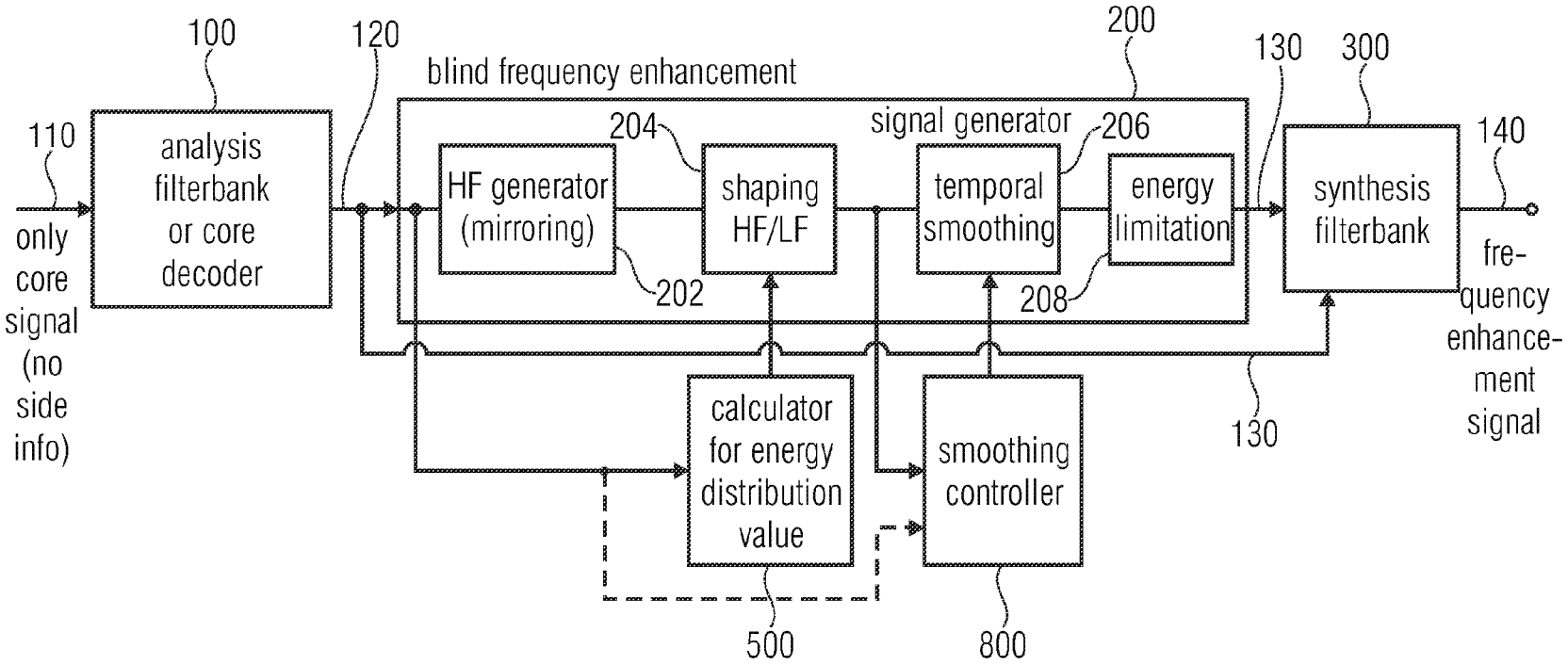
FIG. 1 illustrates an embodiment comprising the technologies of shaping a frequency enhancement signal, the smoothing of the subband signal and the energy limitation.

FIG. 1 illustrates an apparatus for generating a frequency enhanced signal 140 in an implementation, in which the technologies of shaping, temporal smoothing and energy limitation are performed all together. However, these technologies can also be individually applied as discussed in the context of FIGS. 5 to 7 for the shaping technology, FIGS. 8 to 10 for the smoothing technology and FIGS. 11 to 13 for the energy limitation technology.

Advantageously, the apparatus for generating the frequency enhanced signal 140 of FIG. 1 comprises an analysis filterbank or a core decoder 100 or any other device for providing the core signal in the filterbank domain such as in a QMF domain, when the core decoder outputs QMF subband signals. Alternatively, the analysis filterbank 100 can be a QMF filterbank or another analysis filterbank, when the core signal is a time domain signal or is provided in any other domain than a spectral or subband domain.

The individual subband signals of the core signal 110 which are available at 120 are then input into a signal generator 200 and the output of the signal generator 200 is an enhancement signal 130. This enhancement signal 130 comprises an enhancement frequency range which is not included in the core signal 110 and the signal generator generates this enhancement signal not e.g. by (only) shaping noise or so, but using the core signal 110 or advantageously the core signal subbands 120. The synthesis filterbank then combines the core signal subbands 120 and the frequency enhancement signal 130, and the synthesis filterbank 300 then outputs the frequency enhanced signal.

Basically, the signal generator 200 comprises a signal generation block 202 which is indicated as "HF generation" where HF stands for high frequency. However, the frequency enhancement in FIG. 1 is not limited to the technology that a high frequency is generated. Instead, also a low frequency or an intermediate frequency can be generated and there can even be a regeneration of a spectral hole in the core signal, i.e. when the core signal has a higher band and a lower band and when there is a missing intermediate band, as is for example known from intelligent gap filling (IGF). The signal generation 202 may comprise copy-up procedures as known from HE-AAC or mirroring procedures, i.e. where, in order to generate the high frequency range or frequency enhancement range, the core signal is mirrored rather than copied up.

Furthermore, the signal generator comprises a shaping functionality 204, which is controlled by the calculation for calculating a value indicating the energy distribution with respect to frequency in the core signal 120. This shaping may be a shaping of the signal generated by block 202 or alternatively the shaping of the low frequency, when the order between functionality 202 and 204 is reversed as discussed in the context of FIG. 2*a* to FIG. 2*c*.

Figure 2A:
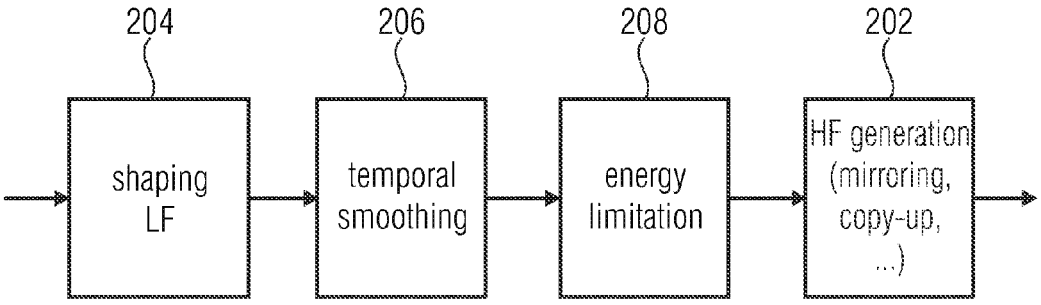
FIG. 2*a*-2*c* illustrate different implementations of the signal generator of FIG. 1.

A further functionality is the temporal smoothing functionality 206, which is controlled by a smoothing controller 800. An energy limitation 208 may be performed at the end of the procedure, but the energy limitation can also be placed at any other position in the chain of processing functionalities 202 to 208 as long as it is made sure that the combined signal output by the synthesis filterbank 300 fulfills the energy limitation criterion such as that a higher frequency band must not have more energy than the adjacent lower frequency band or that the higher frequency band must not have more energy compared to the adjacent lower frequency band, where the increment is limited, at the most, to a predefined threshold such as 3 dB FIG. 2*a* illustrates a different order, in which the shaping 204 is performed together with the temporal smoothing 206 and the energy limitation 208 before performing the HF generation 202. Thus, the core signal is shaped/smoothed/limited and then the already completed shaped/smoothed/limited signal is copied-up or mirrored into the enhancement frequency range. Furthermore, it is important to understand that the order of blocks 204, 206, 208 can be performed in any way as can also be seen when FIG. 2*a* is compared to the order of the corresponding blocks in FIG. 1.

Figure 2B:
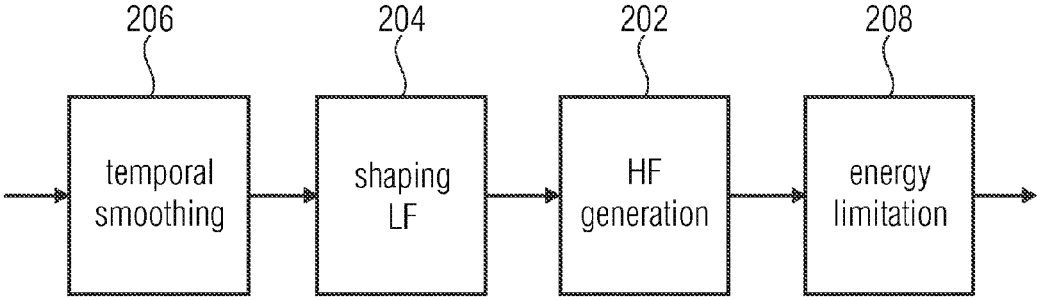
Figure 2C:
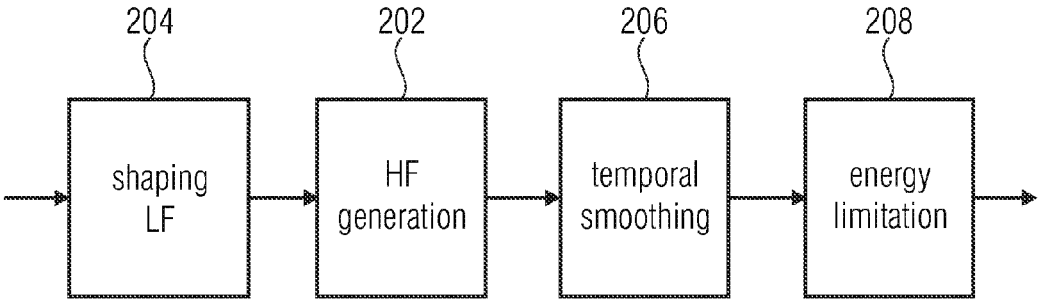

FIG. 2*b* illustrates a situation, in which the temporal smoothing and the shaping is performed on the low frequency or core signal, and the HF generation 202 is then performed before the energy limitation 208. Furthermore, FIG. 2*c* illustrates a situation where the shaping of the signal is performed to the low frequency signal and a subsequent HF generation such as by copy-up or mirroring is performed in order to obtain the signal for the enhancement frequency range, and this signal is then smoothed 206 and energy-limited 208.

Figure 14:
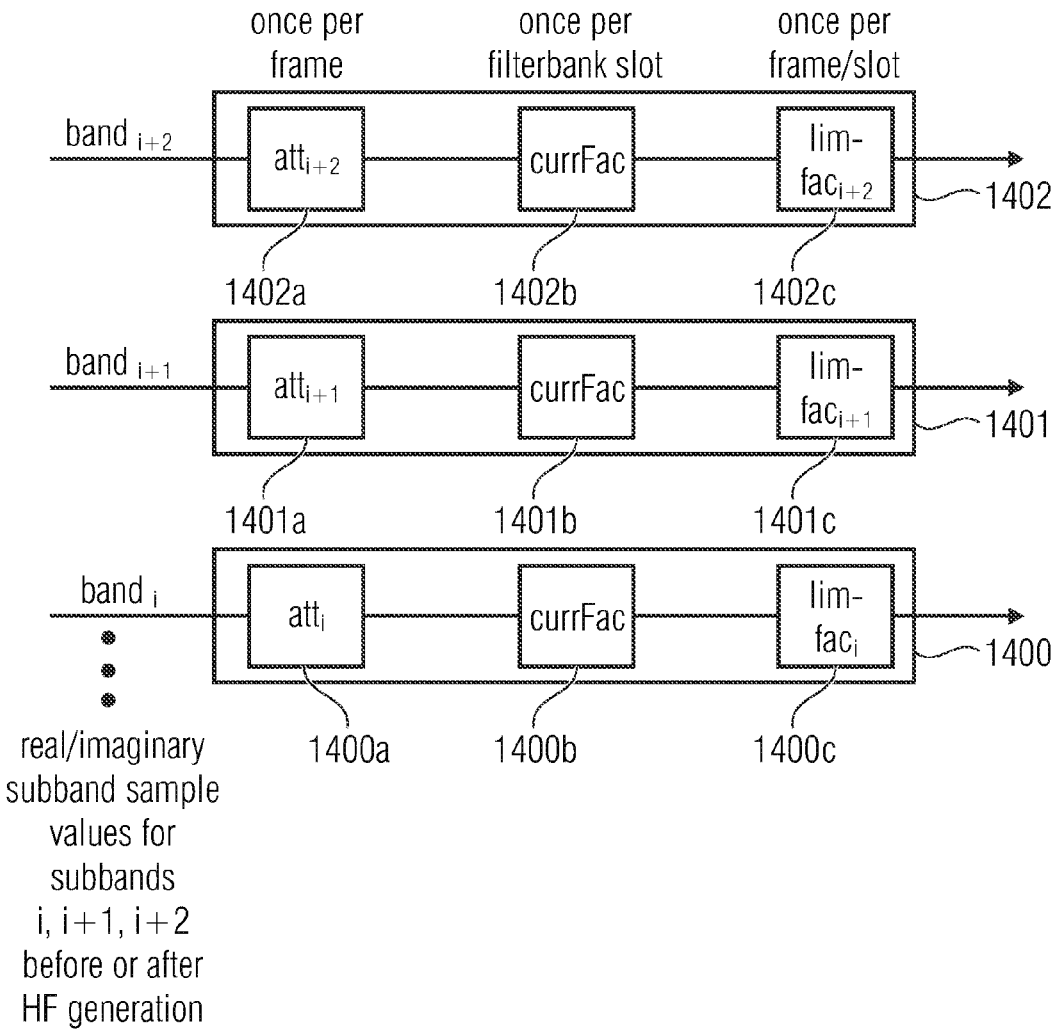
FIG. 14 illustrates the concurrent application of the technologies of shaping, smoothing and energy limitation within a filterbank domain.

Furthermore, it is to be emphasized that the functionalities of shaping, temporal smoothing and energy limiting may all be performed by applying certain factors to a subband signal as, for example, illustrated in FIG. 14. The shaping is implemented by multipliers 1402*a*, 1401*a* and 1400*a* for individual bands i, i+1, i+2.

Furthermore, the temporal smoothing is performed by multipliers 1402*b*, 1401*b* and 1400*b*. Additionally, the energy limitation is performed by limitation factors 1402*c*, 1401*c* and 1400*c* for the individual bands i+2, i+1 and i. Due to the fact that all of these functionalities are implemented in this embodiment by multiplication factors, it is to be noted that all these functionalities can also be applied to the individual subband signals by a single multiplication factor 1402, 1401, 1400 for each individual band, and this single "master" multiplication factor would then be a product of the individual factors 1402*a*, 1402*b* and 1402*c* for a band i+2, and the situation would be analogous to the other bands i+1 and i. Thus, the real/imaginary subband samples values for the subbands are then multiplied by this single "master" multiplication factor and the output is obtained as multiplied real/imaginary subband sample values at the output of block 1402, 1401 or 1400, which are then introduced into the synthesis filterbank 300 of FIG. 1. Thus, the output of blocks 1400, 1401, 1402 corresponds to the enhancement signal 1300 typically covering the enhancement frequency range not included in the core signal.

Figure 3:
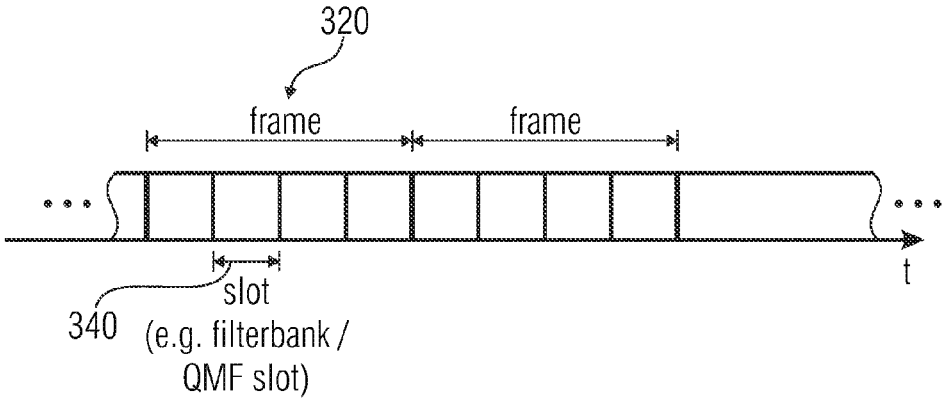
FIG. 3 illustrates individual time portions, where a frame has a long time portion and a slot has a short time portion and each frame comprises a plurality of slots.

FIG. 3 illustrates a chart indicating different time resolutions used in the process of signal generation. Basically, the signal is processed frame-wise. This means that the analysis filterbank 100 may be implemented to generate time-subsequent frames 320 of subband signals, where each frame 320 of subband signals comprises a one or a plurality of slots or filterbank slots 340. Although FIG. 3 illustrates four slots per frame, there can also be 2, 3 or even more than four slots per frame. As illustrated in FIG. 14, the shaping of the enhancement signal or the core signal based on the energy distribution of the core signal is performed once per frame. On the other hand, the temporal smoothing is performed with a high time resolution, i.e. advantageously once per slot 340 and the energy limitation can once again be performed once per frame when a low complexity is necessitated, or once per slot when a higher complexity is non-problematic for the specific implementation.

Figure 4:
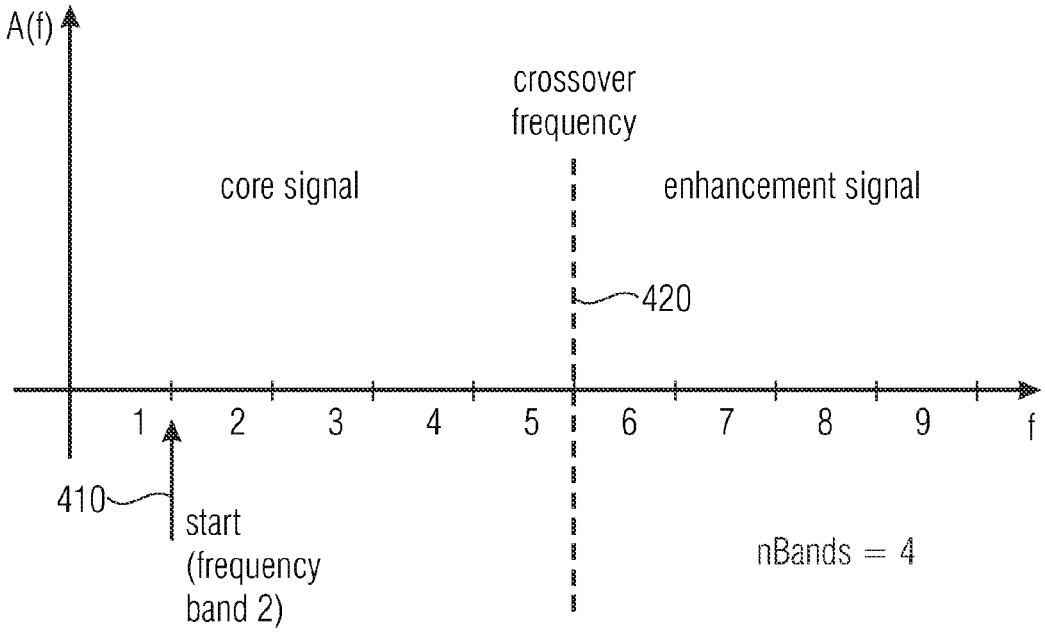
FIG. 4 illustrates a spectral chart indicating the spectral position of a core signal and an enhancement signal in an implementation of a bandwidth extension application.

FIG. 4 illustrates a representation of a spectrum having five subbands 1, 2, 3, 4, 5 in the core signal frequency range. Furthermore, the example in FIG. 4 has four subband signals or subbands 6, 7, 8, 9 in the enhancement signal range and the core signal range and the enhancement signal range are separated by a crossover frequency 420. Furthermore, a start frequency band 410 is illustrated, which is used for calculating the value describing an energy distribution with respect to frequency for the purpose of shaping 204, as will be discussed later on. This procedure makes sure that the lowest or a plurality of lowest subbands are not used for the calculation of the value describing the energy distribution with respect to frequency in order to obtain a better enhancement signal adjustment.

Subsequently, an implementation of the generation 202 of the enhancement frequency range not included in the core signal using the core signal is illustrated.

In order to generate the artificial signal above the crossover frequency, typically QMF values from the frequency range below the crossover frequency are copied ("patched") up into the high band. This copy-operation can be done by just shifting QMF samples from the lower frequency range up to the area above the crossover frequency or by additionally mirroring these samples. The advantage of the mirroring is that the signal just below the crossover frequency and the artificial generated signal will have a very similar energy and harmonic structure at the crossover frequency. The mirroring or copy up can be applied to a single subband of the core signal or to a plurality of subbands of the core signal.

In the case of said QMF filterbank, the mirrored patch advantageously consists of the negative complex conjugate of the base band in order to minimize subband aliasing in the transition region:

$$Qr(t,\text{xover}+f-1)=-Qr(t,\text{xover}-f);\ f=1\ldots n\text{Bands}$$

$$Qi(t,\text{xover}+f-1)=Qi(t,\text{xover}-f);\ f=1\ldots n\text{Bands}$$

Here, Qr(t, f) is the real value of the QMF at time-index t and subband-index f and Qi(t, f) is the imaginary value; xover is the QMF subband referring to the crossover frequency; nBands is the integer number of bands to be extrapolated. The minus sign in the real part denotes the negative conjugate complex operation.

Advantageously, the HF generation 202 or generally the generation of the enhancement frequency range relies on a subband representation provided by block 100. Advantageously, the inventive apparatus for generating a frequency enhanced signal should be a multi-bandwidth decoder which is able to resample the decoded signal 110 to vary sampling frequencies, to support, for example narrow band, wideband and super-wideband output. Therefore, the QMF filterbank 100 takes the decoded time domain signal as input. By padding zeroes in the frequency domain, the QMF filterbank can be used to resample the decoded signal, and the same QMF filterbank may also be used to create the high band signal.

Advantageously, the apparatus for generating a frequency enhanced signal is operative to perform all operations in the frequency domain. Thus, an existing system already having an internal frequency domain representation at a decoder side is extended as illustrated in FIG. 1 by indicating block 100 as a "core decoder" which provides, for example, already a QMF filterbank domain output signal.

This representation is simply re-used for additional tasks like sampling rate conversion and other signal manipulations which may be done in the frequency domain (e.g. insertion of shaped comfort noise, high-pass/low-pass filtering). Thus, no additional time-frequency transformation needs to be calculated.

Instead of using noise for the HF content, the high-band signal is generated based on the low-band signal only in this embodiment. This can be done by means of a copy-up or folding-up (mirroring) operation in the frequency domain. Thus, a high band signal with the same harmonic and temporal fine-structure as the low band signal is assured. This avoids a computationally costly folding of the time-domain signal and additional delay.

Subsequently, the functionality of the shaping 204 technology of FIG. 1 is discussed in the context of FIGS. 5, 6, and 7, where the shaping can be performed in the context of FIG. 1, 2*a*-2*c* or separately and individually together with other functionalities known from other guided or non-guided frequency enhancement technologies.

Figure 5:
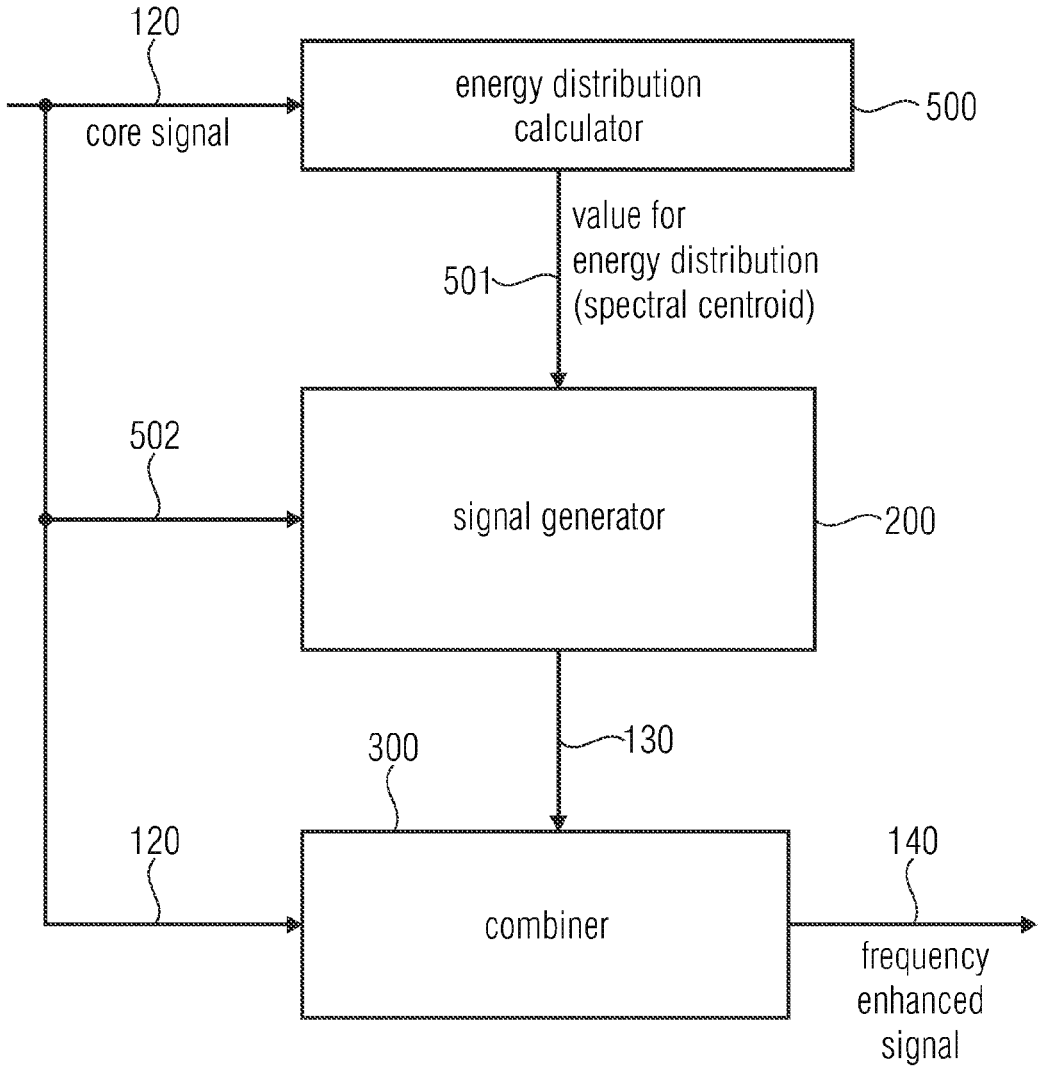
FIG. 5 illustrates an apparatus for generating the frequency enhanced signal using a spectral shaping based on the value describing an energy distribution of the core signal.

FIG. 5 illustrates an apparatus for generating a frequency enhanced signal 140 comprising a calculator 500 for calculating a value describing an energy distribution with respect to frequency in a core signal 120. Furthermore, the signal generator 200 is configured for generating an enhancement signal comprising an enhancement frequency range not included in the core signal from the core signal as illustrated by line 502. Furthermore, the signal generator 200 is configured for shaping the enhancement signal such as output by block 202 in FIG. 1 or the core signal 120 in the context of FIG. 2*a* so that a spectral envelope of the enhancement signal depends on the value describing the energy distribution.

Advantageously, the apparatus additionally comprises a combiner 300 for combining the enhancement signal 130 output by block 200 and the core signal 120 to obtain the frequency enhanced signal 140. Additional operations such as temporal smoothing 206 or energy limitation 208 are of advantage to further process the shaped signal, but are not necessarily necessitated in certain implementations.

The signal generator 200 is configured to shape the enhancement signal so that a first spectral envelope decrease from a first frequency in the enhancement frequency range to a second higher frequency in the enhancement frequency range is obtained for a first value describing the energy distribution. Furthermore, a second spectral envelope decrease from the first frequency in the enhancement range to the second frequency in the enhancement range is obtained for a second value describing a second energy distribution. If the second frequency is greater than the first frequency, and the second spectral envelope decrease is greater than the first spectral envelope decrease, then the first value indicates that the core signal has an energy concentration at a higher frequency range of the core signal compared to the second value describing an energy concentration at a lower frequency range of the core signal.

Advantageously, the calculator 500 is configured to calculate a measure for a spectral centroid of a current frame as the information value on the energy distribution. Then, the signal generator 200 shapes in accordance with this measure for the spectral centroid so that a spectral centroid at a higher frequency results in a more shallow slope of the spectral envelope compared to a spectral centroid at a lower frequency.

The information on the energy distribution calculated by the energy distribution calculator 500 is calculated on a frequency portion of the core signal starting at the first frequency and ending at the second frequency being higher than the first frequency. The first frequency is lower than a lowest frequency in the core signal, as for example illustrated at 410 in FIG. 4. Advantageously, the second frequency is the crossover frequency 420 but can also be a frequency lower than the crossover frequency 420 as the case may be. However, extending the second frequency used for calculating the measure for the spectral distribution as much as possible to the crossover frequency 420 is of advantage and results in the best audio quality.

Figure 6:
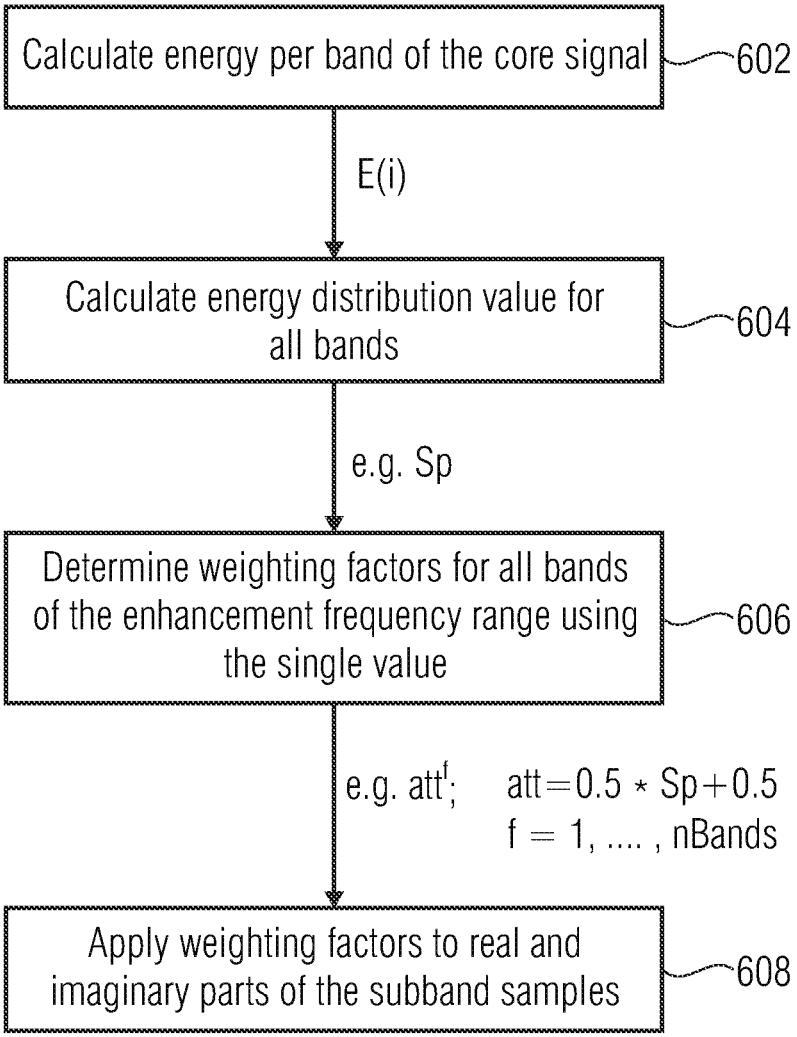
FIG. 6 illustrates an implementation of the shaping technology.

In an embodiment, the procedure of FIG. 6 is applied by the energy distribution calculator 500 and the signal generator 200. In step 602, an energy value for each band of the core signal indicated at E(i) is calculated. Then, a single energy distribution value such as sp used for the adjustment of all bands of the enhancement frequency range is calculated in block 604. Then, in step 606, weighting factors are calculated for all bands of the enhancement frequency range using for this a single value, where the weighting factors may be $att^f$.

Then, in step 608 performed by the signal generator 208, the weighting factors are applied to real and imaginary parts of the subband samples.

Fricative sounds are detected by calculating the spectral centroid of the current frame in the QMF domain. The spectral centroid is a measure that has a range of 0.0 to 1.0. A high spectral centroid (a value close to one) means that the spectral envelope of the sound has a rising slope. For speech signals this means that the current frame most likely contains a fricative. The closer the value of the spectral centroid approaches one, the steeper is the slope of the spectral envelope or the more energy is concentrated in the higher frequency range.

The spectral centroid is calculated according to:

$$sp = \frac{\sum_{i=start}^{xover} i * E(i)}{(xover - \text{start} + 1) * \sum_{i=start}^{xover} E(i)}$$

where E(i) is the energy of QMF subband i and start is the QMF subband-index referring to 1 kHz. The copied QMF subbands are weighted with the factor $att^f$:

$$\widetilde{Qr}\,(t,\text{xover}+f)=Qr(t,\text{xover}+f)*att^f;\ f=1\ .\ .\ .\ n\text{Bands}$$

where att=0.5*sp+0.5. Generally, att can be calculated using the following equation:

$$att=p(sp),$$

wherein p is a polynomial. Advantageously, the polynomial has degree 1:

$$att=a*sp+b,$$

wherein a, b or generally the polynomial coefficients are all between 0 and 1.

Apart from the above equation, other equations having a comparable performance can be applied. Such other equations are as follows:

$$sp = \frac{\sum_{i=start}^{xover} ai * E(i)}{bi * \sum_{i=start}^{xover} E(i)}$$

In particular, the value $a_i$ should be so that the value is higher for higher i and, importantly, the values $b_i$ are lower than the values $a_i$ at least for the index i>1. Thus, a similar result, but with a different equation compared to the above equation, is obtained. Generally, ai, bi are monotonically increasing or decreasing values with i.

Figure 7:
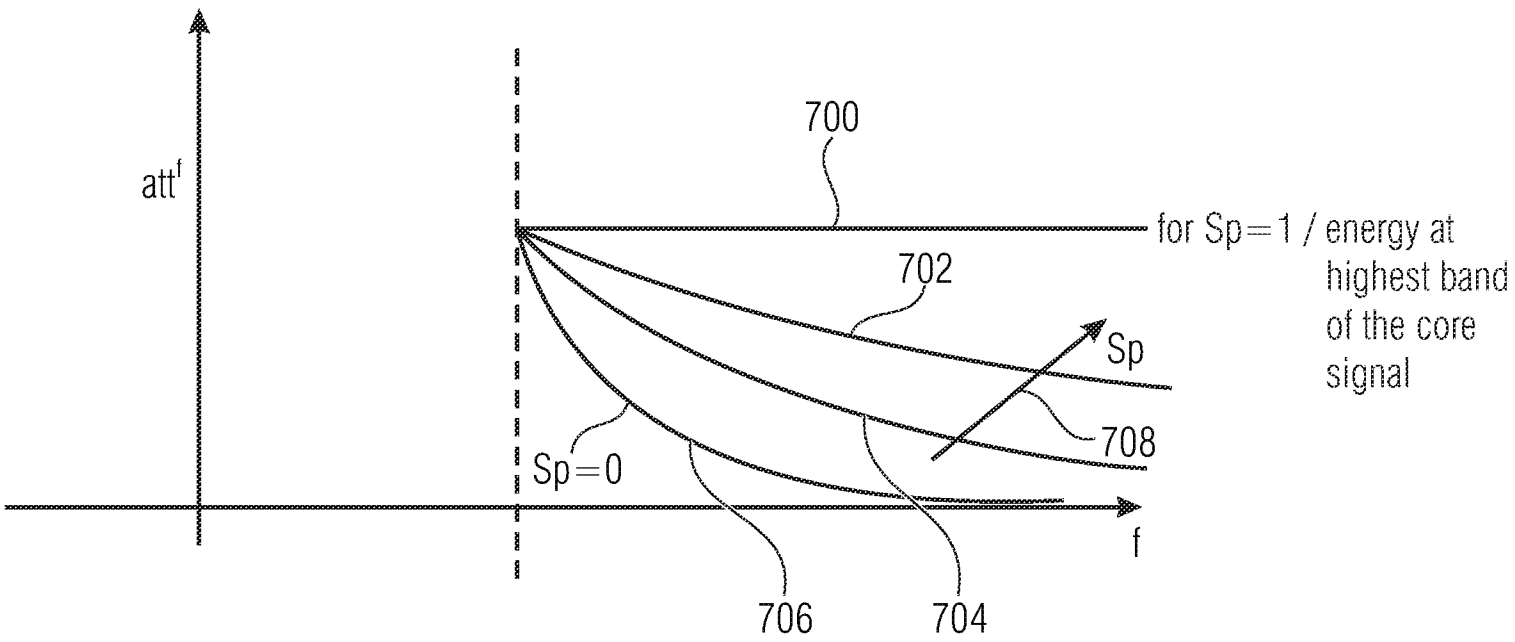
FIG. 7 illustrates different roll-offs determined by a certain spectral centroid.

Furthermore, reference is made to FIG. 7. FIG. 7 illustrates individual weighting factors $att^f$ for different energy distribution values sp. When sp is equal to 1, then the whole energy of the core signal is concentrated at the highest band the core signal. Then, att is equal to 1 and the weighting factors $att^f$ are constant over frequency as illustrated at 700. When, on the other hand, the complete energy in the core signal is concentrated at the lowest band of the core signal, then sp is equal to 0 and att is equal to 0.5 and the corresponding course of the adjustment factors over frequency illustrated at 706.

Courses of shaping factors over frequency indicated at 702 and 704 are for correspondingly increasing spectral distribution values. Thus, for item 704, the energy distribution value is greater than 0 but smaller than the energy distribution value for item 702 as indicated by parametric arrow 708.

Figure 8:
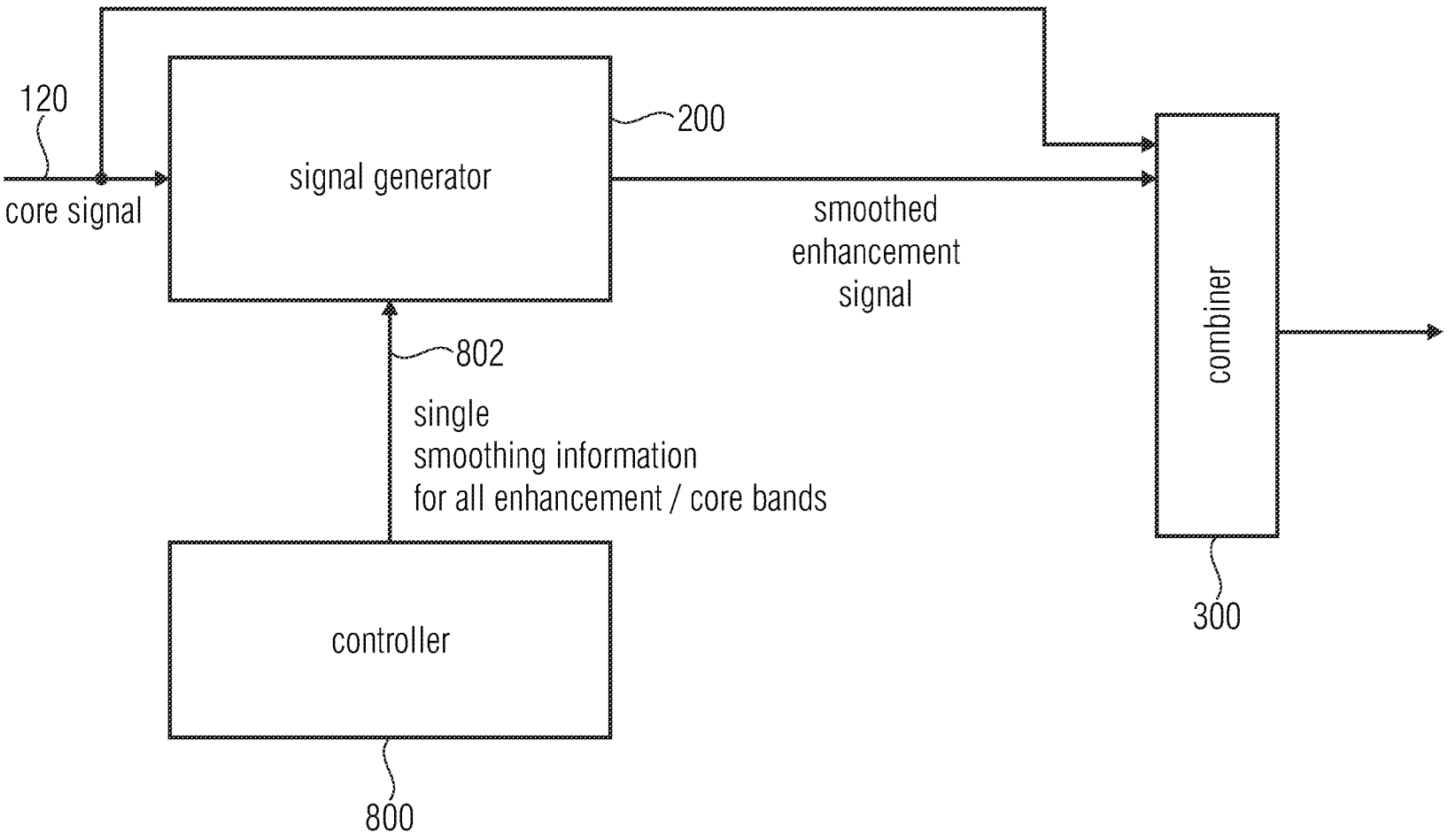
FIG. 8 illustrates an apparatus for generating the frequency enhanced signal comprising the same smoothing information for smoothing the subband signals of the core signal or the frequency enhancement signal.

FIG. 8 illustrates an apparatus for generating a frequency enhanced signal using the temporal smoothing technology. The apparatus comprises a signal generator 200 for generating an enhancement signal from a core signal 120, 110, where the enhancement signal comprises an enhancement frequency range not included in the core signal. A current time portion such as a frame 320 and advantageously a slot 340 of the enhancement signal or the core signal comprises subband signals for a plurality of subbands.

A controller 800 is for calculating the same smoothing information 802 for the plurality of subband signals of the enhancement frequency range or the core signal. Furthermore, the signal generator 200 is configured for smoothing the plurality of subband signals of the enhancement frequency range using the same smoothing information 802 or for smoothing the plurality of subband signals of the core signal using the same smoothing information 802. The output of the signal generator 200 is, in FIG. 8, a smooth enhancement signal which can then be input into a combiner 300. As discussed in the context of FIGS. 2*a*-2*c*, the smoothing 206 can be performed at any place in the processing chain of FIG. 1 or can even be performed individually in the context of any other frequency enhancement scheme.

The controller 800 may be configured to calculate the smoothing information using a combined energy of the plurality of subband signals the core signal and the frequency enhancement signal or using only the frequency enhancement signal of the time portion. Furthermore, an average energy of the plurality of subband signals of the core signal and the frequency enhancement signal or of the core signal only of one or more earlier time portions preceding the current time portion is used. The smoothing information is a single correction factor for the plurality of subband signals of the enhancement frequency range in all bands and therefore the signal generator 200 is configured to apply the correction factor to the plurality of subband signals of the enhancement frequency range.

As discussed in the context of FIG. 1, the apparatus furthermore comprises a filterbank 100 or a provider for providing the plurality of subband signals of the core signal for a plurality of time-subsequent filterbank slots. Furthermore, the signal generator is configured to derive the plurality of subband signals of the enhancement frequency range for the plurality of time-subsequent filterbank slots using the plurality of subband signals of the core signal and the controller 800 is configured to calculate an individual smoothing information 802 for each filterbank slot and the smoothing is then performed, for each filterbank slot, with a new individual smoothing information.

The controller 800 is configured to calculate a smoothing intensity control value based on the core signal or the frequency enhanced signal of the current time portion and based on one or more preceding time portions and the controller 800 is then configured to calculate the smoothing information using the smoothing control value such that the smoothing intensity varies depending on a difference between an energy of the core signal or the frequency enhancement signal of the current time portion and the average energy of the core signal or the frequency enhancement signal of the one or more preceding time portions.

Figure 9:
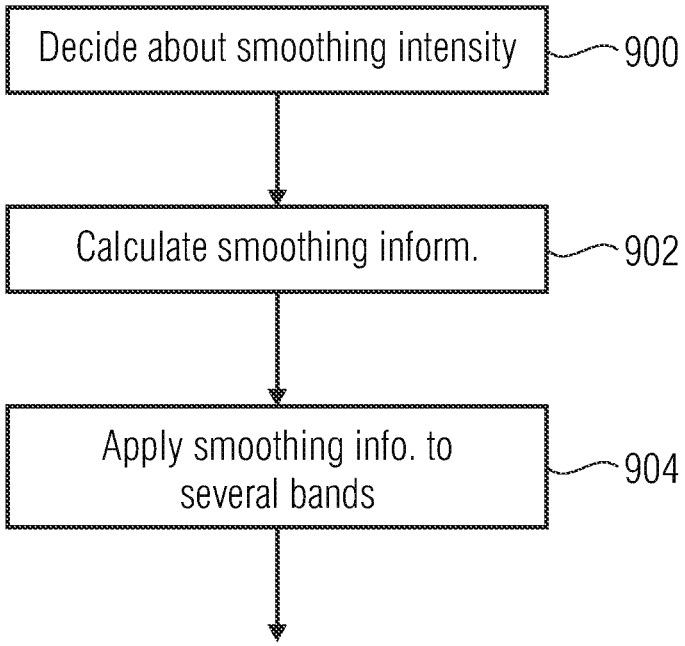
FIG. 9 illustrates a procedure applied by the controller and the signal generator of FIG. 8.

Reference is made to FIG. 9 illustrating a procedure performed by the controller 800 and the signal generator 200. Step 900, which is performed by the controller 800, comprises finding a decision about smoothing intensity which may, for example, be found based on a difference between the energy in the current time portion and an average energy in one or more preceding time portions, but any other procedures for deciding about the smoothing intensity can be used as well. One alternative is to used, instead or in addition future time slots. A further alternative is that one only has a single transform per frame and one would then smooth over timely subsequent frames. Both these alternatives, however, can introduce a delay. This can be non-problematic in applications, where delay is not a problem, such as streaming application. For applications, where a delay is problematic such as for a two way communication e.g. using mobile phones, the past or preceding frames are of advantage over future frames, since the usage of the past frames does not introduce a delay.

Then, in step 902, a smoothing information is calculated based on the decision of the smoothing intensity of the step 900. This step 902 is also performed by the controller 800. Then, the signal generator 200 performs 904 comprising the application of the smoothing information to several bands, where one and the same smoothing information 802 is applied to these several bands either in the core signal or in the enhancement frequency range.

Figure 10:
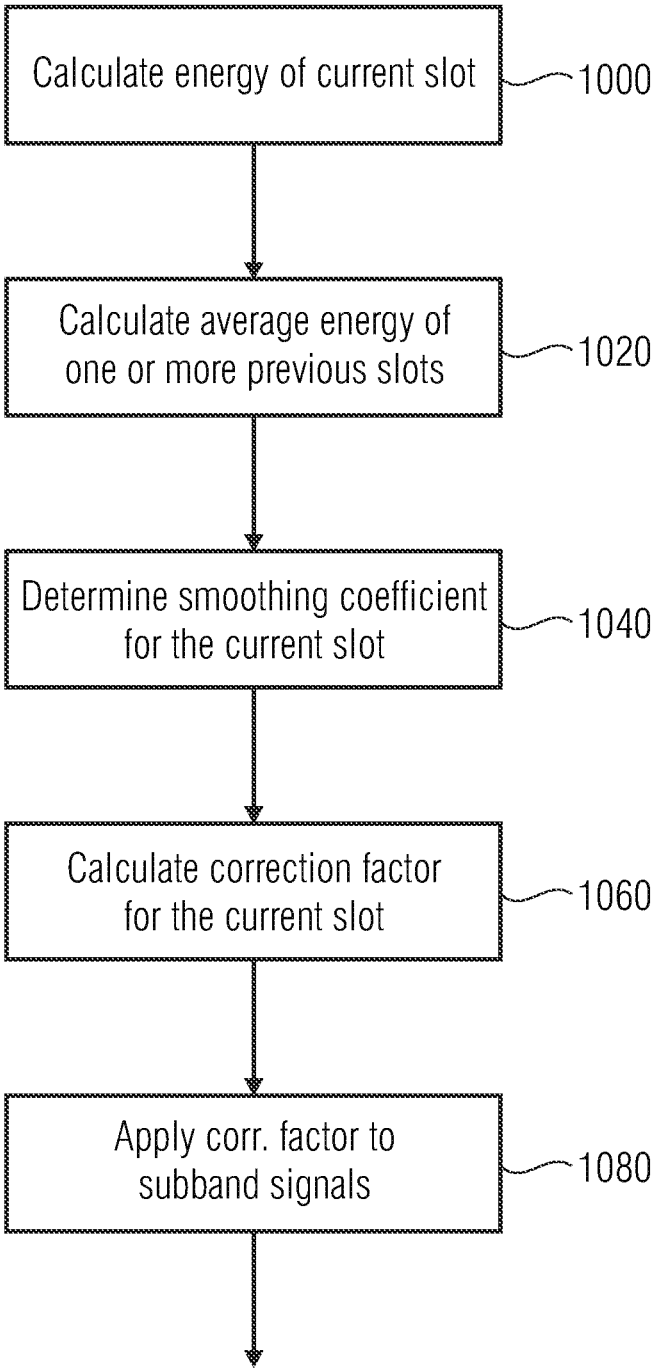
FIG. 10 illustrates a further procedure applied by the controller and the signal generator of FIG. 8.

FIG. 10 illustrates an advantageous procedure of the implementation of the FIG. 9 sequence of steps. In step 1000, an energy of a current slot is calculated. Then, in step 1020, an average energy of one or more previous slots is calculated. Then, in step 1040, a smoothing coefficient for the current slot is determined based on the difference between the values obtained by block 1000 and 1020. Then, step 1060 comprises the calculation of a correction factor for the current slot and the steps 1000 to 1060 are all performed by the controller 800. Then, in step 1080, which is performed by the signal generator 200, the actual smoothing operation is performed, i.e. the corresponding correction factor is applied to all subband signals within one slot.

In an embodiment, the temporal smoothing is performed in two steps:

Decision about smoothing intensity. For the decision about the smoothing intensity, the stationary of the signal over time is evaluated. A possible way to perform this evaluation is to compare the energy of the current short-term window or QMF time-slot with averaged energy values of previous short-term windows or QMF time-slots. To save on complexity, this might be evaluated for the high-band portion only. The closer the compared energy values are, the lower should be the intensity of smoothing. This is reflected in a smoothing coefficient $\alpha$, where $0<\alpha\leq 1$. The greater $\alpha$, the higher is the intensity of smoothing.

Application of smoothing to the high-band. The smoothing is applied for the high-band portion on a QMF time-slot base. Therefore, the high-band energy of the current time-slot $Ecurr_t$ is adapted to an averaged high-band energy $Eavg_t$ of one or multiple previous QMF time-slots:

$$\widehat{Ecurr}_t = \alpha Ecurr_t + (1-\alpha) Eavg_t$$

Ecurr is calculated as the sum of high-band QMF energies in one timeslot:

$$Ecurr_t = \sum_{f=xover}^{xover+nBands} Qr_{t,f}^2 + Qi_{t,f}^2.$$

Eavg is the moving average over time of the energies:

$$Eavg = \frac{1}{\text{stop} - \text{start}} \sum_{t=start}^{stop} Ecurr_t$$

where start and stop are the borders of the interval used for calculating the moving average.

The real and imaginary QMF values used for synthesis are multiplied with a correction factor currFac:

$$\widehat{Qr}_{t,f} = \text{currFac}\,Qr_{t,f}$$

$$\widehat{Qr}_{t,f} = \text{currFac}\,Qi_{t,f}$$

which is derived from Ecurr and Eavg:

$$currFac = \sqrt{\frac{aEcurr_t + (1-a)Eavg_t}{Ecurr_t}}$$

The factor α may be fixed or dependent on the difference of the energy of Ecurr and Eavg.

As already discussed in FIG. 14, the time resolution for the temporal smoothing is set to be higher than the time resolution of the shaping or the time resolution of the energy limitation technology. This makes sure that a temporally smooth course of the subband signals is obtained while, at the same time, the computationally more intensive shaping is to be performed only once per frame. However, any smoothing from one subband to the other subband, i.e. in the frequency direction, is not performed, since, as has been found, this substantially reduces the subjective listening quality.

It is of advantage to use the same smoothing information such as the correction factor for all subbands in the enhancement range. However, it can also be an implementation, in which the same smoothing information is applied not for all bands but for a group of bands wherein such a group has at least two subbands.

Figure 11:
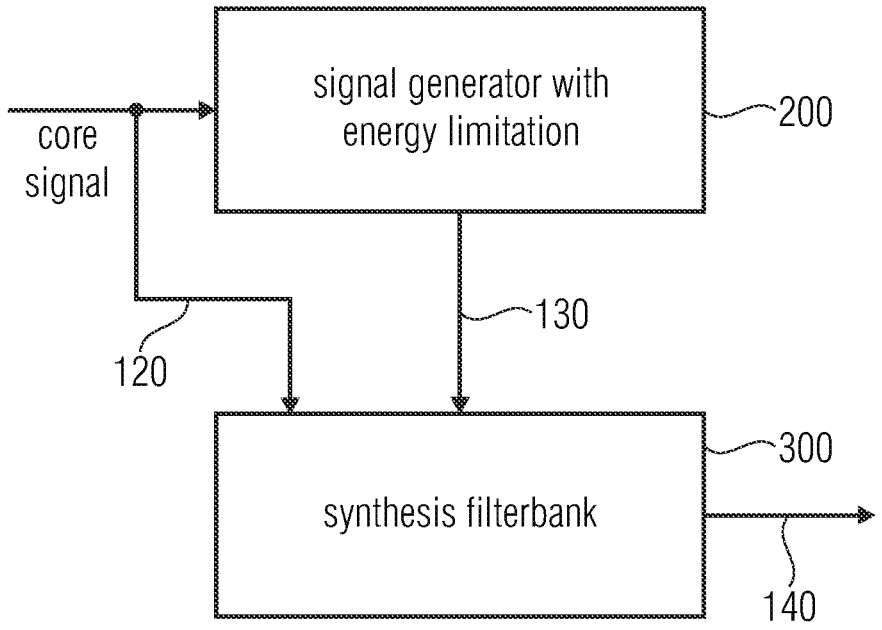
FIG. 11 illustrates an apparatus for generating a frequency enhanced signal, which performs an energy limitation procedure in the enhancement signal so that a higher band of the enhancement signal may, at the most, have the same energy of the adjacent lower band or is, at the most, higher in energy by a predefined threshold.

FIG. 11 illustrates a further aspect directed to the energy limitation technology 208 illustrated in FIG. 1. Specifically, FIG. 11 illustrates an apparatus for generating a frequency enhanced signal comprising the signal generator 200 for generating an enhancement signal, the enhancement signal comprising an enhancement frequency range not included in the core signal. Furthermore, a time portion of the enhancement signal comprises subband signals for a plurality of subbands. Additionally, the apparatus comprises a synthesis filterbank 300 for generating the frequency enhanced signal 140 using the enhancement signal 130.

In order to implement the energy limitation procedure, the signal generator 200 is configured for performing an energy limitation in order to make sure that the frequency enhanced signal 140 obtained by the synthesis filterbank 300 is so that an energy of a higher band is, at the most, equal to an energy in a lower band or greater than the energy in a lower band, at the most, by a predefined threshold.

The signal generator may be implemented to make sure that a higher QMF subband k must not exceed the energy at a QMF subband k−1. Nevertheless, the signal generator 200 can also be implemented to allow a certain incremental increase which may be a threshold of 3 dB and a threshold may be 2 dB and advantageously 1 dB or even smaller. The predetermined threshold may be a constant for each band or dependent on the spectral centroid calculated previously. An advantageous dependence is that the threshold becomes lower, when the centroid approaches lower frequencies, i.e. becomes smaller, while the threshold can become greater the closer the centroid approaches higher frequencies or sp approaches 1.

In a further implementation, the signal generator 200 is configured to examine a first subband signal in a first subband and to examine a subband signal in a second subband being adjacent in frequency to the first subband and having a center frequency being higher than a center frequency of the first subband and the signal generator will not limit the second subband signal, when an energy of the second subband signal is equal to an energy of the first subband signal or when the energy of the second subband signal is greater than the energy of the first subband signal by less than the predefined threshold.

Furthermore, the signal generator is configured to form a plurality of processing operations in a sequence as illustrated, for example, in FIG. 1 or FIGS. 2*a*-2*c*. Then, the signal generator may perform the energy limitation at an end of the sequence to obtain the enhancement signal 130 input into the synthesis filterbank 300. Thus, the synthesis filterbank 300 is configured to receive, as an input, the enhancement signal 130 generated at the end of the sequence by the final process of the energy limitation.

Furthermore, the signal generator is configured to perform spectral shaping 204 or temporal smoothing 206 before the energy limitation.

In an embodiment, the signal generator 200 is configured to generate the plurality of subband signals of the enhancement signal by mirroring a plurality of subbands of the core signal.

For the mirroring, the procedure of negating either the real part or the imaginary part may be performed as discussed earlier.

In a further embodiment, the signal generator is configured for calculating a correction factor limFac and this limitation factor limFac is then applied to the subband signals of the core or the enhancement frequency range as follows:

Let $E_f$ be the energy of one band averaged over a time span stop-start:

$$E_f = \sum_{t=start}^{stop} Qr_{t,f}^2 + Qi_{t,f}^2$$

If this energy exceeds the average energy of the previous band by some level, the energy of this band is multiplied by a correction/limitation factor limFac:

$$\text{if } E_f > fac * E_{f-1}$$

$$limFac = \sqrt{\frac{fac * E_{f-1}}{E_f}}$$

and the real and imaginary QMF values are corrected by:

$$\widehat{Qr}_{t,f} = \text{limFac}\,Qr_{t,f}$$

$$\widehat{Qr}_{t,f} = \text{limFac}\,Qi_{t,f}$$

The factor or predetermined threshold fac may be a constant for each band or dependent on the spectral centroid calculated previously.

$\hat{Q}r_{t,f}$ is the energy limited real part of subband signal at the subband indicated by f. $\hat{Q}i_{t,f}$ is the corresponding imaginary part of a subband signal subsequent to energy limitation in a subband f. $Qr_{t,f}$ and $Qi_{t,f}$ are corresponding real and imaginary parts of the subband signals before energy limitation such as the subband signals directly when any shaping or temporal smoothing is not performed or the shaped and temporally smoothed subband signals.

In another implementation, the limitation factor limFac is calculated using the following equation:

$$limFac = \sqrt{\frac{E_{lim}}{E_f(i)}}.$$

In this equation, $E_{lim}$ is the limitation energy, which is typically the energy of the lower band or the energy of the lower band incremented by the certain threshold fac. $E_f(i)$ is the energy of the current band f or i.

Figure 12A:
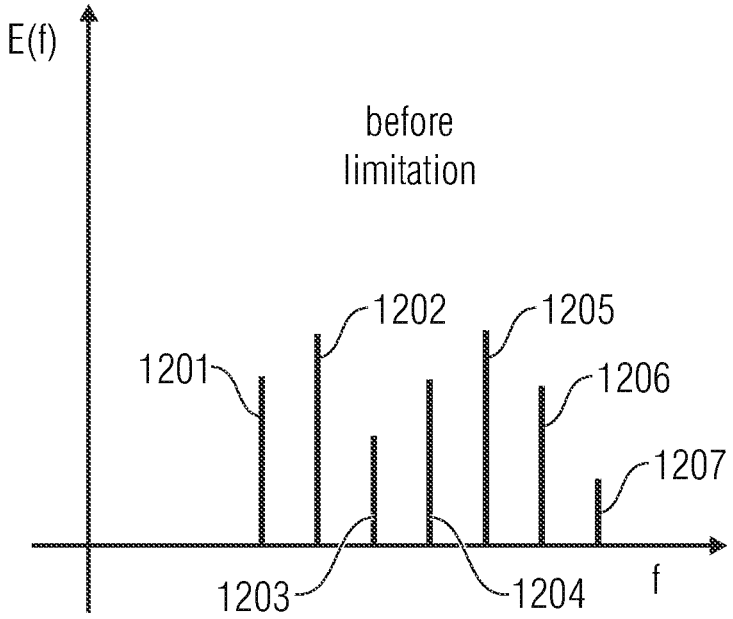
FIG. 12*a* illustrates the spectrum of the enhancement signal before limitation.
Figure 12B:
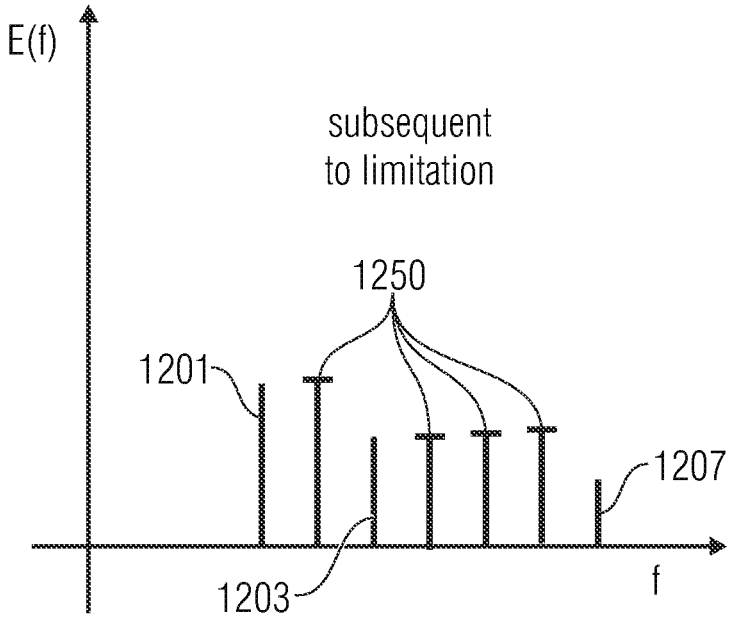
FIG. 12*b* illustrates the spectrum of FIG. 12*a* subsequent to the limitation.
Figure 13:
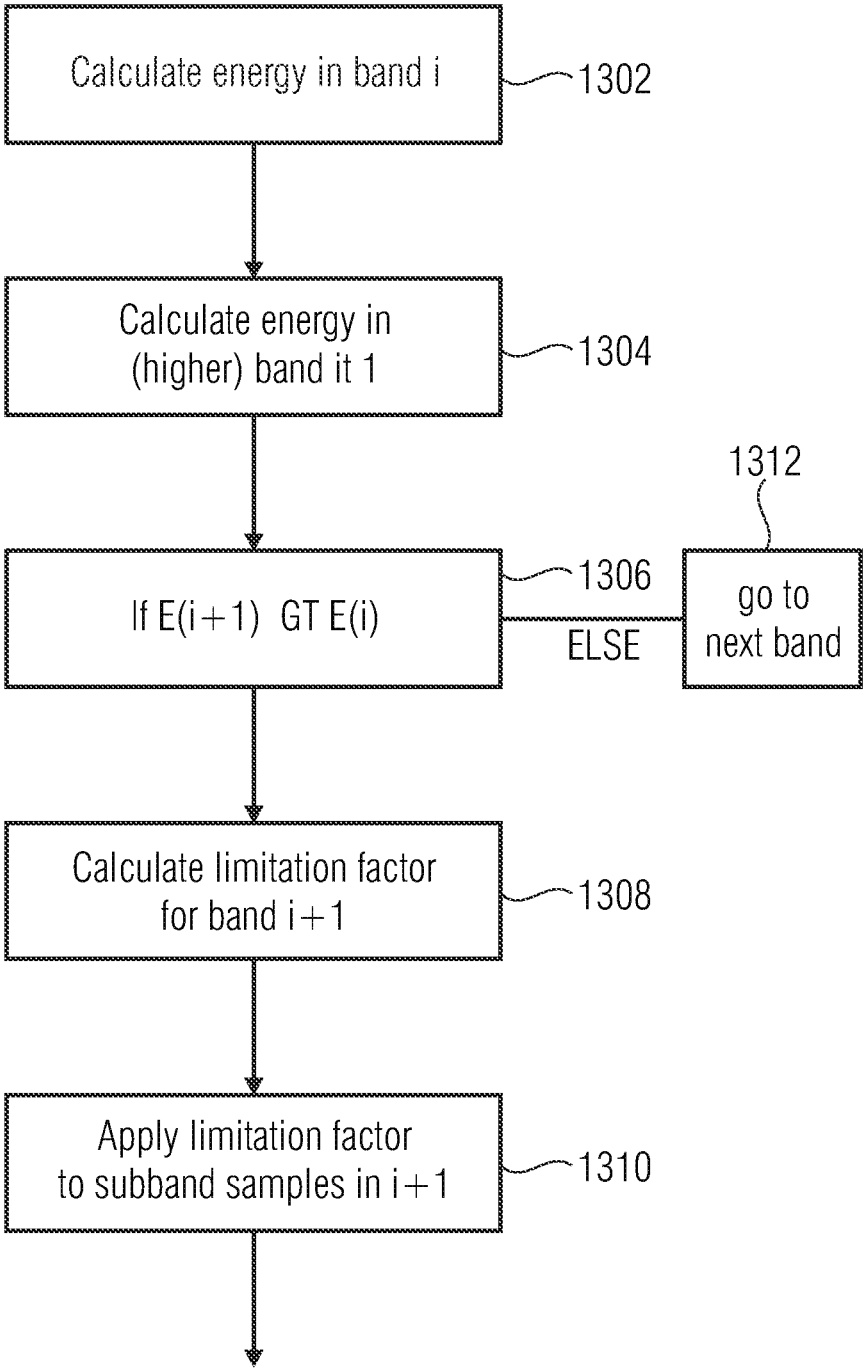
FIG. 13 illustrates a process performed by the signal generator in an implementation.

Reference is made to FIGS. 12*a* and 12*b* illustrating a certain example where there are seven bands in the enhancement frequency range. Band 1202 is greater than band 1201 with respect to energy. Thus, as becomes clear from FIG. 12*b*, band 1202 is energy-limited as indicated at 1250 in FIG. 12*b* for this band. Furthermore, bands 1205, 1204 and 1206 are all greater than band 1203. Thus, all three bands are energy-limited as illustrated as 1250 in FIG. 12*b*. The only non-limited bands that remain are bands 1201 (this is the first band in the reconstruction range) and bands 1203 and 1207.

As outlined, FIG. 12*a*/12*b* illustrates the situation where the limitation is so that a higher band must not have more energy than a lower band. However, the situation would look a bit different if a certain increment would have been allowed.

The energy limitation may apply for a single extension band. Then, the comparison or energy limitation is done using the energy of the highest core band. This may also apply for a plurality of extension bands. Then a lowest extension band is energy limited using the highest core band, and a highest extension band is energy limited with respect to the second to highest extension band.

Figure 15:
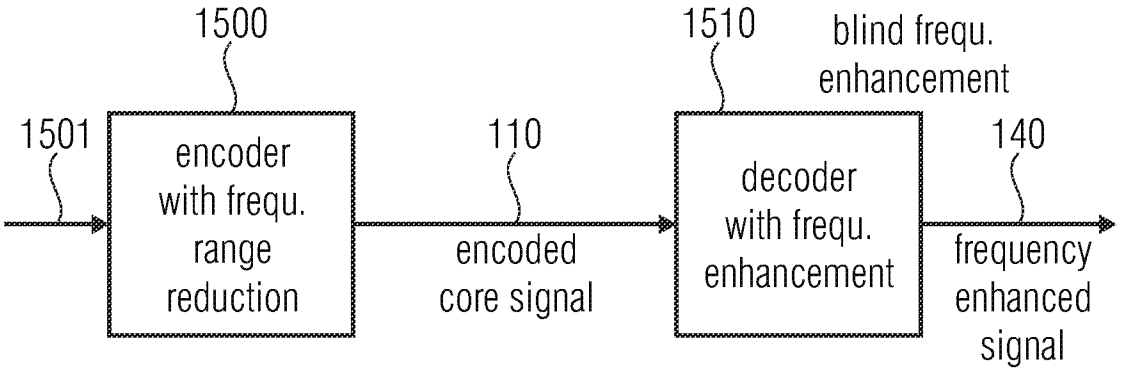
FIG. 15 illustrates a system comprising an encoder and a non-guided frequency enhancement decoder.

FIG. 15 illustrates a transmission system or, generally, a system comprising an encoder 1500 and a decoder 1510. The encoder may be an encoder for generating the encoded core signal which performs a bandwidth reduction, or generally which deletes several frequency ranges in the original audio signal 1501, which do not necessarily have to be a complete upper frequency range or upper band, but which can also be any frequency band in between core frequency bands. Then, the encoded core signal is transmitted from the encoder 1500 to the decoder 1510 without any side information and the decoder 1510 then performs a non-guided frequency enhancement to obtain the frequency enhancement signal 140. Thus, the decoder can be implemented as discussed in any of the FIGS. 1 to 14.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for generating a frequency enhancement audio signal, comprising:

a signal generator configured for generating the frequency enhancement audio signal from a core audio signal, the frequency enhancement audio signal comprising an enhancement frequency range not comprised in the core audio signal, wherein a current time portion of the frequency enhancement audio signal or the core audio signal comprises subband signals for a plurality of subbands; and a controller configured for calculating the same smoothing information for the plurality of subband signals of the enhancement frequency range or the core audio signal, and wherein the signal generator is configured for smoothing the plurality of subband signals of the enhancement frequency range or the core audio signal using the same smoothing information, wherein the controller is configured to calculate the same smoothing information using a combined energy of the plurality of subband signals of the core audio signal and the frequency enhancement audio signal or using the combined energy of the plurality of subband signals of only the frequency enhancement audio signal of the current time portion, and wherein the controller is configured to use an average energy of the plurality of subband signals of the core audio signal and the frequency enhancement audio signal or of the core audio signal only of one or more earlier time portions preceding the current time portion or one or more later time portions following the current time portion, wherein at least one of the controller and the signal generator comprises a hardware implementation.

2. The apparatus of claim 1, wherein the same smoothing information is a single correction factor for the plurality of subband signals of the enhancement frequency range, and wherein the signal generator is configured to apply the single correction factor to the plurality of subband signals of the enhancement frequency range.

3. The apparatus in accordance with claim 1, further comprising a filterbank or a provider for providing the plurality of subband signals of the core audio signal for a plurality of time-subsequent filterbank slots, wherein the signal generator is configured to derive the plurality of subband signals of the enhancement frequency range for the plurality of time-subsequent filterbank slots using the plurality of subband signals of the core audio signal, and wherein the controller is configured to calculate an individual smoothing information for each filterbank slot.

4. The apparatus in accordance with claim 1, wherein the controller is configured to calculate a smoothing intensity control value based on the core audio signal or the frequency enhancement audio signal of the current time portion and one or more preceding time portions, and wherein the controller is configured to calculate the same smoothing information using the smoothing control value in such a way that the smoothing intensity varies dependent on a difference between an energy of the core audio signal or the frequency enhancement audio signal in the current time portion and an average energy in the core audio signal or the frequency enhancement audio signal of one or more preceding time portions.

5. The apparatus in accordance with claim 1, wherein the controller is configured to calculate the same smoothing information based on the following equation:

$$currFac = \sqrt{\frac{aEcurr_t + (1-a)Eavg_t}{Ecurr_t}}$$

wherein $Ecurr_t$ is an energy in the current time portion, wherein $Eavg_t$ is an average of one or more preceding or later time portions, and wherein a is a parameter controlling the smoothing intensity, and wherein the signal generator is configured to apply the same smoothing information on each subband sample of the plurality of subbands of the frequency enhanced signal.

6. The apparatus in accordance with claim 1, wherein the signal generator is configured for shaping the core audio signal or the frequency enhancement audio signal in addition to smoothing.

7. The apparatus of claim 6, wherein the current time portion and at least one further time portion form a frame, wherein the signal generator is configured for applying the same shaping information for a whole frame, and wherein the signal generator is configured for smoothing using an individual smoothing information for each time portion within the frame.

8. The apparatus in accordance with claim 1, wherein the signal generator is configured for performing an energy limitation on the frequency enhancement audio signal or the core audio signal in order to make sure that a signal acquired by a synthesis filterbank is so that an energy of a higher band is, at the most, equal to an energy in a lower band or greater than, at the most, by a predefined threshold of 3 dB or less.

9. The apparatus in accordance with claim 1, wherein the signal generator is configured for mirroring a single subband signal of the core audio signal or the plurality of subband signals of the core audio signal when calculating the plurality of subband signals of the frequency enhancement audio signal.

10. A method of generating a frequency enhancement audio signal, comprising:

generating, by a signal generator, the frequency enhancement audio signal from a core audio signal, the frequency enhancement audio signal comprising an enhancement frequency range not comprised in the core audio signal, wherein a current time portion of the frequency enhancement audio signal or the core audio signal comprises subband signals for a plurality of subbands;

calculating, by a controller, the same smoothing information for the plurality of subband signals of the enhancement frequency range or the core audio signal, and wherein the generating comprises smoothing the plurality of subband signals of the enhancement frequency range or the core audio signal using the same smoothing information, wherein the calculating comprises calculating the same smoothing information using a combined energy of the plurality of subband signals of the core audio signal and the frequency enhancement audio signal or using the combined energy of the plurality of subband signals of only the frequency enhancement audio signal of the current time portion, and wherein the calculating comprises using an average energy of the plurality of subband signals of the core audio signal and the frequency enhancement audio signal or of the core audio signal only of one or more earlier time portions preceding the current time portion or one or more later time portions following the current time portion, wherein at least one of the controller and the signal generator comprises a hardware implementation.

11. A system for processing audio signals, comprising:

an encoder for generating an encoded core audio signal; and an apparatus for generating a frequency enhancement audio signal of claim 1, wherein at least one of the encoder and the apparatus comprises a hardware implementation.

12. A method of processing audio signals, comprising:

generating, by an encoder, an encoded core audio signal; and generating, by an apparatus, a frequency enhancement audio signal using a method of generating the frequency enhancement audio signal, the method of generating the frequency enhancement audio signal comprising:

generating the frequency enhancement audio signal from a core audio signal, the frequency enhancement audio signal comprising an enhancement frequency range not comprised in the core audio signal, wherein a current time portion of the frequency enhancement audio signal or the core audio signal comprises subband signals for a plurality of subbands;

calculating the same smoothing information for the plurality of subband signals of the enhancement frequency range or the core audio signal, and wherein the generating comprises smoothing the plurality of subband signals of the enhancement frequency range or the core audio signal using the same smoothing information, wherein the calculating comprises calculating the same smoothing information using a combined energy of the plurality of subband signals of the core audio signal and the frequency enhancement audio signal or using the combined energy of the plurality of subband signals of only the frequency enhancement audio signal of the current time portion, and wherein the calculating comprises using an average energy of the plurality of subband signals of the core audio signal and the frequency enhancement audio signal or of the core audio signal only of one or more earlier time portions preceding the current time portion or one or more later time portions following the current time portion, wherein at least one of the encoder and the apparatus comprises a hardware implementation.

13. A non-transitory storage medium having stored thereon a computer program for performing, when running on a computer or a processor, a method of generating a frequency enhancement audio signal, the method comprising:

generating the frequency enhancement audio signal from a core audio signal, the frequency enhancement audio signal comprising an enhancement frequency range not comprised in the core audio signal, wherein a current time portion of the frequency enhancement audio signal or the core audio signal comprises subband signals for a plurality of subbands;

calculating the same smoothing information for the plurality of subband signals of the enhancement frequency range or the core audio signal, and wherein the generating comprises smoothing the plurality of subband signals of the enhancement frequency range or the core audio signal using the same smoothing information, wherein the calculating comprises calculating the same smoothing information using a combined energy of the plurality of subband signals of the core audio signal and the frequency enhancement audio signal or using the combined energy of the plurality of subband signals of only the frequency enhancement audio signal of the current time portion, and wherein the calculating comprises using an average energy of the plurality of subband signals of the core audio signal and the frequency enhancement audio signal or of the core audio signal only of one or more earlier time portions preceding the current time portion or one or more later time portions following the current time portion.

14. A non-transitory storage medium having stored thereon a computer program for performing, when running on a computer or a processor, the method of processing audio signals comprising:

generating an encoded core audio signal; and generating a frequency enhancement audio signal using a method of generating the frequency enhancement audio signal, the method of generating the frequency enhancement audio signal comprising:

generating the frequency enhancement audio signal from a core audio signal, the frequency enhancement audio signal comprising an enhancement frequency range not comprised in the core audio signal, wherein a current time portion of the frequency enhancement audio signal or the core audio signal comprises subband signals for a plurality of subbands;

calculating the same smoothing information for the plurality of subband signals of the enhancement frequency range or the core audio signal, and wherein the generating comprises smoothing the plurality of subband signals of the enhancement frequency range or the core audio signal using the same smoothing information, wherein the calculating comprises calculating the same smoothing information using a combined energy of the plurality of subband signals of the core audio signal and the frequency enhancement audio signal or using only the frequency enhancement audio signal of the current time portion, and wherein the calculating comprises using an average energy of the plurality of subband signals of the core audio signal and the frequency enhancement audio signal or of the core audio signal only of one or more earlier time portions preceding the current time portion or one or more later time portions following the current time portion.

* * * * *